US005911342A

United States Patent [19]

Sindoni

[11] Patent Number: 5,911,342

[45] Date of Patent: Jun. 15, 1999

[54] DYE BATCHING MACHINE

[75] Inventor: Giuseppe Sindoni, Milan, Italy

[73] Assignee: Italtinto S.r.l.,, Carasco, Italy

[21] Appl. No.: 08/795,887

[22] Filed: Feb. 5, 1997

[30] Foreign Application Priority Data

Feb. 9, 1996 [IT] Italy ..... MI96U0104

[51] Int. Cl.[6] ..... B67D 5/60

[52] U.S. Cl. ..... 222/144.5; 141/104; 222/135; 222/144

[58] Field of Search ..... 222/135, 144, 222/144.5; 141/103, 104, 105

[56] References Cited

U.S. PATENT DOCUMENTS 5,078,302 1/1992 Hellenberg ..... 222/144.5

5,445,195 8/1995 Kim ..... 222/144.5

5,474,211 12/1995 Hellenberg ..... 222/144.5

*Primary Examiner*—Robert W. Fetsuga

*Assistant Examiner*—Timothy L. Maust

*Attorney, Agent, or Firm*—Notaro & Michalos P.C.

[57] ABSTRACT

A dye batching machine has a dispensing head and several tanks arranged radially around the dispensing head. The tanks are connected to the dispensing head by means of Victaulic couplings. Each tank is fitted with dye measuring systems and dye mixing systems. A motor system is located above the dispensing head for controlling the dye measuring and mixing systems in the tanks and one or more vertical supports for the motor system are arranged radially around the dispensing head. The lower part of the vertical supports has two or more flat walls that are inserted into free spaces adjacent the Victaulic couplings.

4 Claims, 2 Drawing Sheets

DYE BATCHING MACHINE

FIELD AND BACKGROUND OF THE INVENTION

The subject of this innovation is a batching machine for dyes or liquid pigments.

Similar machines are known, for example, as a result of patents filed by the same applicant.

These machines basically comprise a number of tanks, each equipped with systems designed to mix the dye and systems designed to measure the amount of dye dispensed, which feed a dispensing head.

According to a preferred form of construction of this type of machine, the tanks, which are wedge-shaped, are arranged radially around the dispensing head and connected to it with Victaulic couplings.

In accordance with this technique, an electric motor (designed to control the dispensing and mixing devices associated with each tank by means of a suitable linkage) is fitted above the dispensing head and within the roughly cylindrical volume delineated by the tank assembly.

The said linkage comprises, for example, a recirculating-ball shaft that drives a plate to which rods which control the said dispensing and mixing devices are fixed.

The motor is positioned above the dispensing head by securing the motor flange to a number of vertical columns, usually three, arranged radially around and close to the dispensing head.

However, this technique presents a number of drawbacks. In view of the fact that these machines must enable dyes of numerous different shades to be produced, a relatively large number of tanks is required.

The presence of the rotor support columns is obviously a nuisance because it reduces the number of tanks that can be used with a given dispensing head diameter; this means that dispensing heads with a larger diameter than theoretically necessary have to be employed, which involves higher production costs and larger dimensions.

SUMMARY OF THE INVENTION

The purpose of this innovation is to offer a batching machine which maximizes the number of tanks that can be connected to the dispensing head by minimizing the dimensions of the dispensing head and the batching machine as a whole.

This purpose is achieved by a dye batching machine having a dispensing head and several tanks arranged radially around the dispensing head. The tanks are connected to the dispensing head by means of Victaulic couplings. Each tank is fitted with dye measuring systems and dye mixing systems. A motor system is located above the dispensing head for controlling the dye measuring and mixing systems in the tanks and one or more vertical supports for the motor system are arranged radially around the dispensing head. The lower part of the vertical supports has two or more flat walls that are inserted into free spaces adjacent the Victualic couplings.

BRIEF DESCRIPTION OF THE DRAWINGS

Further advantages of the innovation will become clear from the description of a preferred, but not the only form of construction, illustrated by way of example but not of limitation in the annexed drawings in which.

DESCRIPTION OF THE PREFERRED EMBODIMENTS

Figure 1:
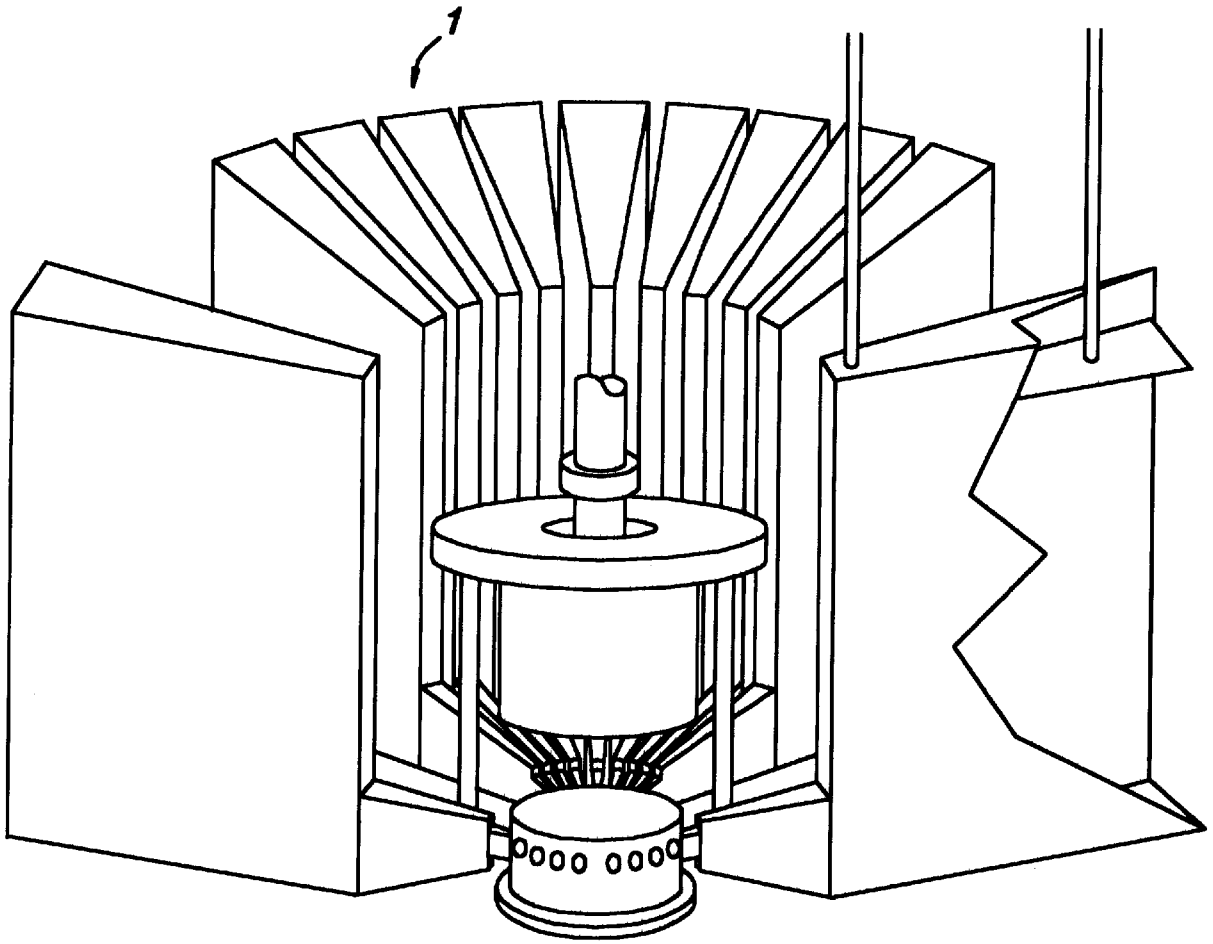
FIG. 1 is a perspective view of a portion of the dispensing system in accordance with the known technique, comprising the dispensing head, the mixing and batching device drive motor, and part of the tanks.
Figure 2:
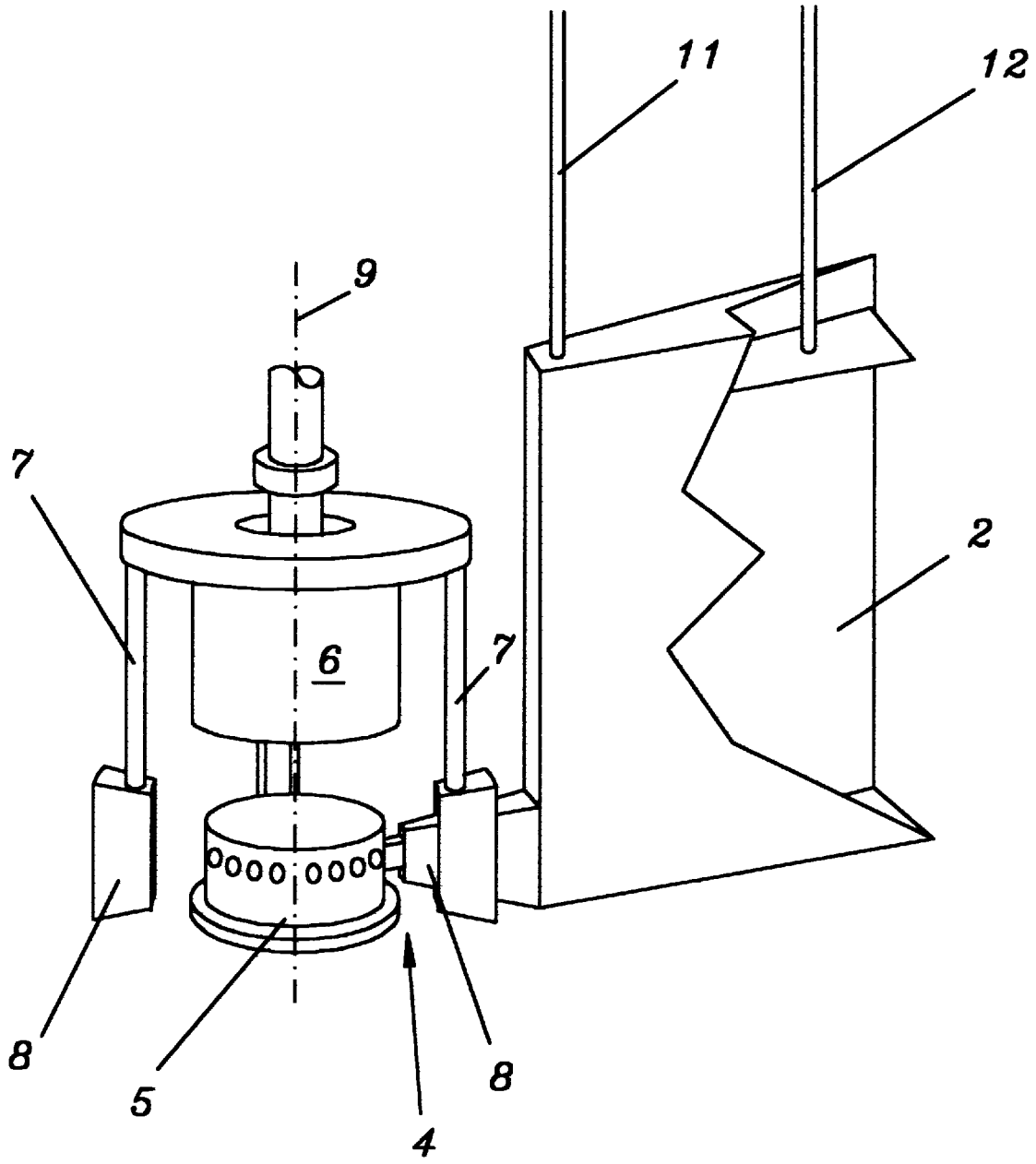
FIG.2 is a perspective view of a portion of the dispensing system in accordance with this innovation.

In the said drawings, number 1 indicates the motor assembly of the batching machine, which comprises a number of tanks 2, preferably wedge-shaped, arranged radially around a dispensing head 5 and connected to it by means of Victaulic couplings 4.

A motor 6 designed to control the dispensing and mixing devices associated with each tank via a mobile plate (not shown) and rods (11 and 12), and simultaneously batch and dispense the dyes from the selected tanks, is fitted above head 5.

The flange of motor 6 is connected to three vertical supports 7, arranged radially around dispensing head 5. The characteristic feature of the innovation is that at least the lower portion of supports 7 is constituted by two flat walls, such as two metal sheets 8, which are inserted into the free area between pairs of adjacent Victaulic couplings 4.

In the preferred form of construction, sheets 8 converge on the axis of symmetry 9 so as to minimize the space appropriated from Victaulic couplings 4. Sheets 8 should preferably be fitted at an angular distance equal to the pitch of Victaulic couplings 4.

The angular distance between sheets 8 could obviously also be a multiple of the pitch of Victaulic couplings 4, so that each sheet can be connected between two adjacent tanks.

In practice, it has been found that the machine as described can advantageously reduce the size of the dispensing head associated with a given number of tanks and the size of the machine as a whole, thus allowing the tanks to be placed side by side along a 360° arc. In practice, any materials or dimensions can be used, as required.

I claim:

1. A dye batching machine comprising:

a dispensing head;

a plurality of tanks arranged radially around the dispensing head, the tanks being connected to the dispensing head by Victaulic couplings and each tank being fitted with dye measuring systems and dye mixing systems;

motor means located above the dispensing head for controlling the dye measuring and mixing systems in each of the plurality of tanks; and at least one vertical support for the motor system arranged radially around the dispensing head, a lower part of the at least one vertical support having at least a pair of spaced apart flat walls that are inserted into spaces between adjacent tanks and the Victaulic couplings, the spaced apart flat walls defining an opening through which at least one of the plurality of tanks is coupled to the dispensing head, such that the vertical support does not interfere with coupling the plurality of tanks to the dispensing head.

2. A dye batching machine according to claim 1, wherein the at least one vertical support comprises three vertical supports.

3. A dye batching machine according to claim 2, wherein the three vertical supports are arranged spaced equidistant from each other.

4. A dye batching machine according to claim 1, wherein the at least a pair of spaced apart walls surround one tank and Victaulic coupling.

* * * * *